United States Patent [19]

Borror et al.

[11] 4,382,119

[45] May 3, 1983

[54] NOVEL PHOTOGRAPHIC PRODUCTS AND PROCESSES

[75] Inventors: Alan L. Borror, Lexington; Ernest W. Ellis, Carlisle, both of Mass.

[73] Assignee: Polaroid Corporation, Cambridge, Mass.

[21] Appl. No.: 382,479

[22] Filed: May 27, 1982

Related U.S. Application Data

[63] Continuation-in-part of Ser. No. 294,311, Aug. 19, 1981, abandoned.

[51] Int. Cl.[3] ..... G03C 5/54; G03C 1/48; G03C 5/38

[52] U.S. Cl. ..... 430/212; 430/228; 430/234; 430/236; 430/251; 430/428; 430/455; 430/566; 430/955

[58] Field of Search ..... 430/251, 234, 212, 222, 430/236, 228, 566, 497, 428, 455, 600, 603, 611, 955

[56] References Cited

U.S. PATENT DOCUMENTS

| | | | |
|---|---|---|---|
| 3,698,898 | 10/1972 | Grasshoff et al. | 430/251 |
| 3,769,014 | 10/1973 | Stewart et al. | 430/251 |
| 3,932,480 | 1/1976 | Grasshoff et al. | 430/251 |
| 3,958,992 | 5/1976 | Greenwald | 430/455 |
| 4,126,459 | 1/1978 | Greenwald | 430/455 |

*Primary Examiner*—Richard L. Schilling
*Attorney, Agent, or Firm*—Sybil A. Campbell

[57] ABSTRACT

This invention relates to photographic products and processes employing silver halide solvent precursors of the formulae wherein $R^1$ and $R^2$, the same or different, each are hydrogen, alkyl, phenalkyl, phenyl or phenyl substituted with an electron-donating or electron-withdrawing group; $R^3$ is alkyl, phenalkyl, phenyl or substituted phenyl; Z is —CN or —$SO_2R^4$ wherein $R^4$ is branched-chain alkyl, phenalkyl, phenyl or substituted phenyl; and n is an integer 3, 4 or 5.

23 Claims, 1 Drawing Figure

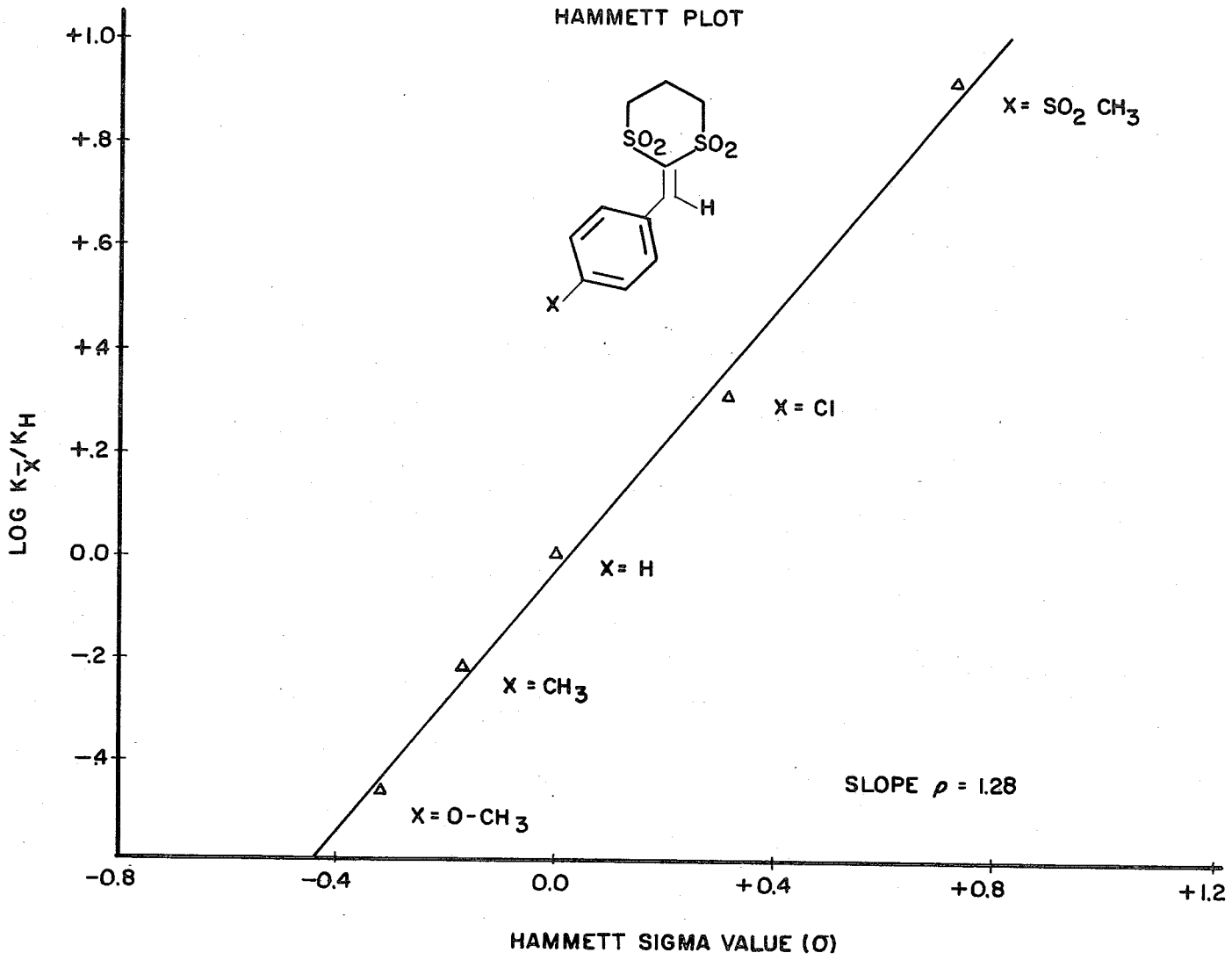
HAMMETT PLOT
X = SO2 CH3
X = Cl
X = H
X = CH3
X = O-CH3
SLOPE ρ = 1.28
SO2
SO2
H
X
+1.0
+.8
+.6
+.4
+.2
0.0
-.2
-.4
LOG kX/kH
-0.8
-0.4
0.0
+0.4
+0.8
+1.2
HAMMETT SIGMA VALUE (σ)

NOVEL PHOTOGRAPHIC PRODUCTS AND PROCESSES

CROSS REFERENCE TO RELATED APPLICATIONS

This application is a continuation-in-part of copending application Ser. No. 294,311, filed Aug. 19, 1981, now abandoned.

BACKGROUND OF THE INVENTION

1. Field of the Invention

This invention relates to compounds which release a silver halide solvent in the presence of alkali and to photographic products and processes employing said compounds.

2. Description of the Prior Art

In various photographic processes for forming images in either black-and-white or in color, it is often desirable to include one or more of the photographic reagents in the photographic film unit. In many instances, the photographic reagent may be contained initially in either the processing composition or in the film unit, the latter being preferred to reduce the number of ingredients in the processing composition. In other instances, the particular photographic reagent selected may not be sufficiently stable in alkali to provide the requisite shelf life of the processing composition, or it may be incompatible, ie.g., reactable with another ingredient in the processing composition. In still other instances, it may be desirable to provide a given reagent at some particular time during the development process which requires positioning of the reagent in a particular layer or layers of the film unit. In all of these instances it is desirable that the reagent initially positioned in the film unit be stable, i.e., substantially inert until it is required during the development process.

One class of compounds which releases a photographic reagent during processing in the presence of alkali is disclosed in U.S. Pat. No. 3,698,898 of J. Michael Grasshoff and Lloyd D. Taylor. These compounds are phenols and naphthols (including protected derivatives thereof) containing a photographic reagent bonded to a nuclear carbon atom through a methylene substituent in a position ortho or para to the hydroxyl group. The photographic reagent released may be an antifoggant, development arrester or restrainer, toning agent, silver halide solvent, etc. U.S. Pat. No. 3,932,480, a continuation-in-part of Ser. No. 230,064 filed Feb. 28, 1972, now abandoned, which, in turn, is a division of aforementioned U.S. Pat. No. 3,698,898 is directed to such compounds which release a thiosulfate silver halide solvent.

The present invention is concerned with another class of compounds that release a silver halide solvent in the presence of alkali.

SUMMARY OF THE INVENTION

It is therefore the primary object of the present invention to provide photographic products and processes employing certain silver halide solvent release compounds.

Other objects of this invention will in part be obvious and will in part appear hereinafter.

The invention accordingly comprises the processes involving the several steps and the relation and order of one or more of such steps with respect to each of the others, and the products and compositions possessing the features, properties and the relation of elements which are exemplified in the following detailed disclosure, and the scope of the application of which will be indicated in the claims.

For a fuller understanding of the nature and objects of the invention, reference should be had to the following detailed description taken in connection with the accompanying drawing.

BRIEF DESCRIPTION OF THE DRAWING

The FIGURE is a graph representing a linear free energy relationship based on the Hammett Equation where a change in the Hammett sigma value for the substituent X of a preferred class of silver halide solvent release compounds of the present invention is linearly correlated with a change in the rate constant for solvent release.

DETAILED DESCRIPTION OF THE INVENTION

According to the present invention, photographic silver halide solvents are released from certain compounds in the presence of alkali during photographic processing. These silver halide solvent release compounds may be represented by the formulae:

(I) 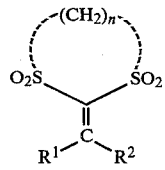

and (II) 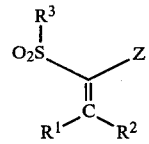

wherein $R^1$ and $R^2$, the same or different, each are hydrogen, alkyl usually having 1 to 20 carbon atoms, phenalkyl wherein said alkyl usually has 1 to 20 carbon atoms, phenyl, or phenyl substituted with an electron-donating or electron-withdrawing group; $R^3$ is alkyl usually having 1 to 20 carbon atoms, phenalkyl wherein said alkyl is usually lower alkyl having 1 to 6 carbon atoms, phenyl or substituted phenyl, e.g., alkyl-substituted phenyl wherein said alkyl usually has 1 to 6 carbon atoms; Z is —CN or $—SO_2—R^4$ wherein $R^4$ is branched-chain alkyl usually having 3 to 6 carbon atoms, phenalkyl wherein said alkyl usually has 1 to 6 carbon atoms, phenyl or substituted phenyl, e.g., alkyl-substituted phenyl wherein said alkyl usually has 1 to 6 carbon atoms and n is an integer 3, 4 or 5. By electron-donating group is intended "a group with a negative sigma value as defined by Hammett's Equation", and by electron-withdrawing group is intended "a group with a positive sigma value as defined by Hammett's Equation".

The alkyl groups comprising $R^1$, $R^2$ and $R^3$ and the alkyl portion of the phenalkyl and alkyl-substituted phenyl groups comprising said $R^1$, $R^2$ and $R^3$ may be straight- or branched-chain alkyl, for example, methyl, ethyl, isopropyl, isobutyl, n-butyl, dodecyl, hexadecyl, etc. The alkyl groups comprising $R^4$ may be, for example, isopropyl, isohexyl, isobutyl or t-butyl. The electron-donating and electron-withdrawing groups may be substituted in the o-, m- or p-position of said phenyl ring. The electron-donating group usually has a negative sigma value of not more than about −0.90, and the electron-withdrawing group usually has a positive sigma value of not more than about 1.00. Examples of useful electron-donating groups include lower alkyl containing 1 to 6 carbon atoms, RO—wherein R is alkyl containing 1 to 20 carbon atoms, $C_6H_5O$—, and —NHR′ wherein R′ is hydrogen or a substituent such as alkyl having 1 to 20 carbon atoms or phenyl. Examples of useful electron-withdrawing groups include F, Cl, Br, I, $CF_3$,

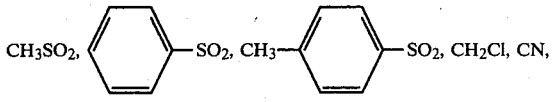

$SO_3$—, $SO_2NHR'$, CONHR′, $COOC_2H_5$, $COCH_3$, $NO_2$ and $SO_2CF_3$ wherein the R′ of said sulfonamido and carboxamido groups has the same meaning given above.

The rate of release of silver halide solvent from the subject precursor compounds is alkali dependent, and this rate can be controlled at a given alkali concentration by the selection of the $R^1$ and $R^2$ groups, the $R_3$ and Z groups and also by the selection of the electron-donating or electron-withdrawing substituent of said $R^1$ and/or $R^2$ groups. The particular $R^1$ and $R^2$ groups and the particular electron-donating or electron-withdrawing substituents needed to achieve the desired release rate at a given pH for a given photographic system may be readily determined empirically. In a preferred embodiment, one of $R^1$ and $R^2$ is hydrogen, and particularly preferred are the compounds of formula I wherein one of $R^1$ and $R^2$ is hydrogen.

The compounds of formula I may be prepared, for example, as shown in the following reaction sequence.

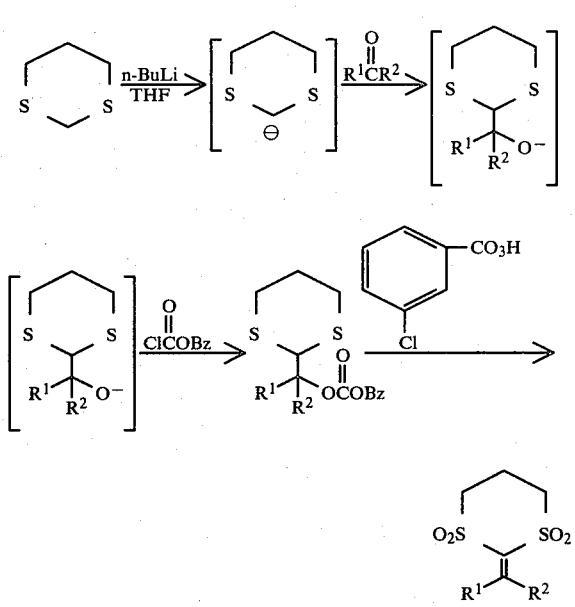

wherein $R^1$ and $R^2$ have the same meaning given above.

The 1,3-dithiane or other 1,3-dithio starting material may be reacted with n-butyllithium in tetrahydrofuran at a temperature between about 0° C. and −70° C., usually −30° to −70° C. to generate the anion followed by addition of the selected aldehyde or ketone to the anion at about −30° C. and preferably, warming this reaction mixture to room temperature to give the 2-substituted carbonol anion intermediate. This intermediate compound is then blocked as an ester, for example, an acetate ester or carbonate ester by reacting the acetylchloride or benzylchloroformate at about −30° C. followed by warming the reaction mixture to room temperature. The resulting ester intermediate is treated with m-chloroperoxybenzoic acid at about −20° C. to −40° C. and then stirred at room temperature or in some instances refluxed up to about 60° C. to complete oxidation to the desired 1,3-disulfone product. This synthetic method forms the subject matter of copending U.S. Patent Application Ser. No. 294,408 of A. L. Borror, E. W. Ellis and C. E. Hammond filed Aug. 19, 1981.

The compounds of formula I also may be synthesized by an extension of the Wittig synthesis reported by Peter F. Jones and M. F. Lappert, J.C.S. Chem. Comm. 1972, p. 526, which comprises reacting either an aldehyde or a ketone with 2-lithio-2-trimethylsilyl-1,3-dithian to give, following aqueous hydrolysis, the alkylidenedithian. This dithian may then be oxidized to the bis-sulfone using m-chloroperbenzoic acid as disclosed by E. J. Corey and G. Märkl, Tetrahedron Letters, 1967, p. 3201.

The compounds of formula II may be synthesized by the base-catalyzed reaction of the appropriate sulfonyl methane and aldehyde as disclosed by E. C. Leonard, J. Org. Chem, 30, 3258 (1965).

The following examples are given to further illustrate the present invention and are not intended to limit the scope thereof.

EXAMPLE 1

Preparation of the compound having the formula

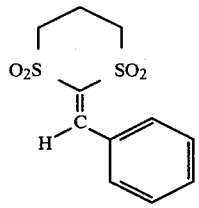

6.01 g of 1,3-Dithiane was dissolved in 250 ml of dry tetrahydrofuran (THF) at room temperature. This solution was cooled to −70° C. and 22 ml of 2.4 M n-butyllithium in hexane was added dropwise. The reaction mixture was allowed to stir at −40° to −15° C. for 2 hours and then cooled to −60° to −70° C. 5.1 ml of Benzaldehyde was added dropwise and the temperature was allowed to come to 0° C. The reaction mixture was then cooled back to −40° C. and 7.5 ml of benzylchloroformate was added dropwise. After stirring at room temperature overnight, the reaction mixture was diluted with ether to approximately 400 ml, filtered into a separatory funnel, washed with water (2×100 ml), dried over sodium sulfate, filtered and the solvent removed leaving a light yellow oil. The oil was placed under high vacuum overnight at room temperature. (A small cluster of white crystals in the oil was observed.) 250 ml of Ethanol was added to the oil and the mixture was stirred at 45°-50° C. for one and one-half hours, then allowed to come to room temperature. The white crystals were collected by filtration, washed with ethanol and air-dried to give 11.6 g of the intermediate having the formula

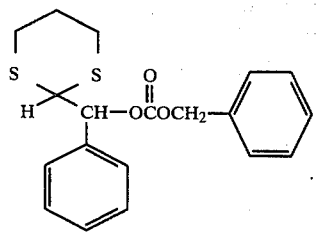

The intermediate prepared above (336 mg) was dissolved in 5 cc of chloroform and the resulting solution cooled to −20° C. To this solution was added a suspension of 794 mg of m-chloroperoxybenzoic acid in 5 ml of chloroform and the mixture was allowed to come to room temperature overnight under nitrogen. The solution was diluted with chloroform and washed with pH 7.5 buffer then with water, dried over sodium sulfate, filtered and the solvent removed to leave the title compound as crystals which were dried under high vacuum.

EXAMPLE 2

Preparation of the compound having the formula

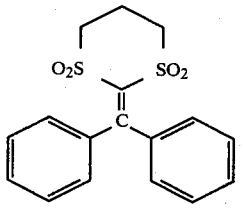

1,3-Dithiane (0.1 mol) was dissolved in 250 ml of dry THF. This solution was cooled to −30° C. and 46 ml of 2.4 M n-butyllithium (approx. 0.1 mol) was added dropwise over 20 minutes. After stirring at −30° C. or below for about one hour, a solution of benzophenone (0.1 mol) in 40 ml dry THF was added dropwise to the reaction mixture at −30° C. over 45 minutes. The resulting mixture was stirred for one and one-half hours at −30° C., then benzylchloroformate was added at −30° C. over 10 minutes. The mixture was allowed to come to room temperature overnight and another 10 ml of benzylchloroformate was added to force the reaction to completion. After stirring at room temperature for several hours, TLC showed one new compound. The carbonate ester intermediate was collected by filtration to give 32 g of said intermediate having the formula

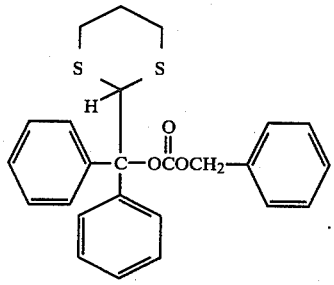

m-Chloroperoxybenzoic acid (12 g) was dissolved in approximately 200 ml of chloroform and the solution cooled to −25° C. The intermediate prepared above (5 g) was added to the solution all at once, and the reaction mixture was allowed to come to room temperature while stirring. After about two and one-half hours at room temperature the solids, m-chlorobenzoic acid, were collected by filtration. The filtrate was cooled to −50° C. and more m-chlorobenzoic acid collected. Again, the filtrate was cooled to −50° C. and the solids collected a third time. The third crop of solids filtered at −50° C. also contained a very small amount of desired product. The filtrate was then concentrated under vacuum to give 5.7 g of a white solid which was crystallized from warm acetone. High pressure liquid chromatography of 4.5 g of this solid using methylene chloride as eluant gave 1.5 g of the title compound which was purified further by recrystallization from methanol.

EXAMPLES 3–6

Preparation of the compounds having the formulae

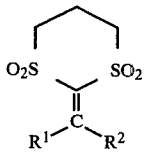

| Example | $R^1$ | $R^2$ |
|---|---|---|
| 3 | −H | 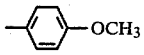 |
| 4 | −H | 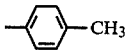 |
| 5 | −H | 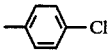 |
| 6 | −H | 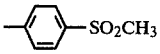 |

The compounds of Examples 3 to 6 were synthesized in the same manner as the compound of Example 2 by dissolving one equivalent of 1,3-dithiane in dry THF, cooling the solution to about −30° C., slowly adding about one equivalent of 2.4 M n-butyllithium to generate the dithiane anion and then slowly adding about one equivalent of the selected aldehyde also at about −30° C. The 2-substituted dithiane carbonol anion intermediate was then reacted with benzylchloroformate at −30° to −40° C. to give the carbonate ester intermediate which was converted to the final product by treating with four to eight equivalents of m-chloroperoxybenzoic acid at −20° to −40° C. in dry chloroform and warming to room temperature.

The elemental analyses for the compounds prepared in Examples 1 to 4 and the elemental analysis for the carbonate ester precursor to the compound prepared in Example 6 are set forth below.

| Ex. | Elemental Analysis | | | | | |
|---|---|---|---|---|---|---|
| | Calculated | | | Found | | |
| No. | C | H | S | C | H | S |
| 1 | 48.51 | 4.44 | 23.54 | 48.49 | 4.40 | 23.64 |
| 2 | 58.60 | 4.59 | 18.40 | 58.39 | 4.57 | 18.22 |
| 3 | 47.67 | 4.66 | 21.22 | 47.74 | 4.67 | 21.03 |
| 4 | 55.33 | 4.93 | 22.39 | 50.25 | 4.93 | 22.24 |

-continued

| Ex. No. | Elemental Analysis Calculated C | H | S | Found C | H | S |
|---|---|---|---|---|---|---|
| 6* | 59.08 | 5.40 | 23.66 | 58.92 | 5.40 | 23.62 |

*Analysis for the carbonate ester having the formula

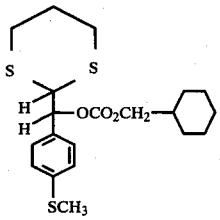

EXAMPLE 7

Preparation of the compound having the formula

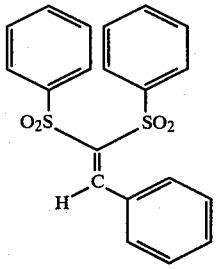

A solution of 2.96 g of bis-phenylsulfonylmethane, 1 ml of benzaldehyde, 0.075 ml of piperidine, 0.2 ml acetic acid and 50 ml of toluene were refluxed for one hour under a Dean-Stark trap. Approximately 2 g of 4 A Molecular Sieves were added to the reaction solution and the solution refluxed another hour. The reaction solution was then cooled to room temperature, filtered, the solvents removed under reduced pressure, 50 ml of ethanol added and stirred overnight at room temperature. The off-white crystals that formed were collected by filtration, washed with ethanol, air-dried and recrystallized from boiling ethanol to give 0.3 g of the title compound. A second crop of 0.75 g was collected after concentrating the mother liquor.

EXAMPLES 8 AND 9

Preparation of the compounds having the formulae

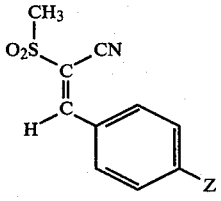

Ex. 8 Z = H  Ex. 9 Z = —COOH

The compounds of Examples 8 and 9 were prepared in the same manner as the compound of Example 7 by condensation of the appropriate aldehyde with, in this instance, methylsulfonylacetonitrile.

The half-life for each of the compounds of Examples 1 to 6 was measured in a conventional manner spectrophotometrically at 22° C. using aqueous 0.25 N KOH containing 30% acetonitrile as the solvent. The half-life for the compound of Example 7 was measured in the same manner except that the KOH was 0.05 N. By "half-life" is meant the time required for one-half of the compound to undergo solvent release in said solution. The results obtained are set forth below.

(III)

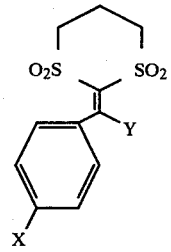

| X | Y | Ex. No. | Half Life (sec.) |
|---|---|---|---|
| $-SO_2CH_3$ | H | 6 | 0.02 |
| —Cl | H | 5 | 0.078 |
| —H | H | 1 | 0.16 |
| $-CH_3$ | H | 4 | 0.26 |
| $-OCH_3$ | H | 3 | 0.46 |
| —H | Ph | 2 | 408 |

The half-life for the compound of Example 7 was 0.115 seconds.

The FIGURE represents the Hammett Plot for Examples 1 and 3 to 6 (where Y of formula III is H) which is based on the equation Log $k_x/k_h=\sigma\rho$.

Presumably, the subject compounds release silver solvent via a Michael addition of hydroxide followed by a retro-aldol reaction which is illustrated below for the compounds of formula I wherein n is 3.

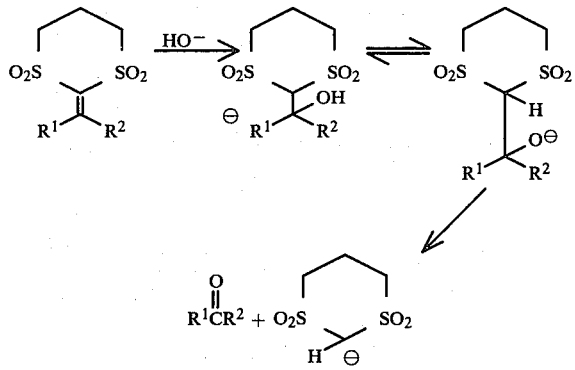

The subject compounds may be employed in any photographic system for forming images in silver or in dye where it is desirable that a silver halide solvent be contained in a particular layer or layers of a film unit in a stable, substantially inert form and yet can be made available at a predetermined concentration and at a predetermined time during processing. The selection of a given compound, of course, will be based on the requirements of the particular photographic process and may be determined empirically.

Though the subject compounds are broadly useful in a variety of photographic systems, they find particular utility in diffusion transfer processes, which processes are now well known. For example, the subject compounds may be employed in silver diffusion transfer processes such as those described in U.S. Pat. No.

2,543,181 issued to Edwin H. Land on Feb. 27, 1951 and U.S. Pat. No. 2,647,056 issued to Edwin H. Land on July 28, 1953 and in numerous other patents.

The compounds of the present invention also may be employed in diffusion transfer processes adapted to provide positive silver transfer images which may be viewed as positive transparencies without being separated from the developed negative silver image including such processes adapted for use in forming additive color projection positive images. Diffusion transfer processes of this type are described, for example, in U.S. Pat. Nos. 3,536,488 and 3,894,871 of Edwin H. Land. The subject compounds also find utility as silver halide solvents in diffusion transfer processes utilizing the properties of the imagewise distribution of silver ions in the soluble silver complex made available in the undeveloped and partially developed areas of a silver halide emulsion to liberate a reagent, e.g., a dye in an imagewise fashion, as described in U.S. Pat. No. 3,719,489 of Ronald F. W. Cieciuch, Roberta R. Luhowy, Frank A. Meneghini and Howard G. Rogers. In addition, it may be desirable to use a silver halide solvent in small amounts in color diffusion transfer processes employing dye developers, such as those disclosed in U.S. Pat. No. 2,983,606.

To illustrate the usefulness of the above-defined compounds in a photographic system, a photosensitive element using as the yellow image dye-providing compound

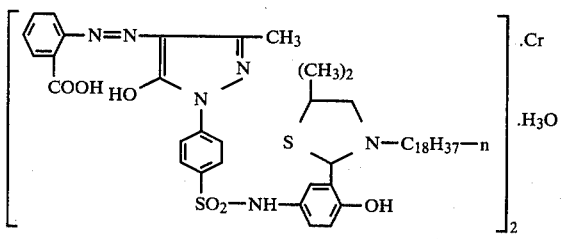

was prepared by coating a transparent polyester film base with the following layers:

1. a layer of said yellow image dye-providing compound dispersed in gelatin and coated at a coverage of 82.5 mgs/ft$^2$ of yellow dye and 41 mgs/ft$^2$ gelatin;

2. a gelatino silver iodobromide emulsion coated at a coverage of 12 mgs/ft$^2$ of silver and 60 mgs/ft$^2$ of gelatin;

3. a layer of gelatin coated at a coverage of 30 mgs/ft$^2$ and containing 2.5 mgs/ft$^2$ of succindialdehyde.

An image-receiving component was prepared by coating a transparent 4 mil polyethylene terephthalate film base with the following layers:

1. as a polymeric acid layer, a mixture of about 9 parts of a partial butyl ester of polyethylene/maleic anhydride copolymer and 1 part of polyvinyl butyral coated at a coverage of about 2,500 mgs/ft$^2$;

2. a timing layer containing a 14:1 ratio of a 60-30-4-6 tetrapolymer of butylacrylate, diacetone acrylamide, styrene and methacrylic acid and polyvinyl alcohol at a coverage of 500 mgs/ft$^2$;

3. a blend of 3 parts by weight of a 2:1 mixture, by weight, of polyvinyl alcohol and poly-4-vinylpyridine and 1 part by weight of a graft copolymer of 4-vinylpyridine and vinylbenzyltrimethylammoniumchloride grafted on hydroxyethyl cellulose in a weight ratio of 2.2/1/2.2, respectively, coated at a coverage of 300 mgs/ft$^2$ to provide an image-receiving layer.

To measure the relative rate of dye transfer as a function of availability of solvent, an unexposed photosensitive element was superposed with an image-receiving component. These two components were then taped together with a rupturable container retaining an aqueous alkaline processing composition mounted on the leading edge of these components, so that, upon application of compressive pressure to rupture the container, its contents are distributed between the image-receiving layer and the gelatin overcoat of the photosensitive element. The aqueous alkaline processing composition comprised:

| Processing Composition A | |
|---|---|
| Water | 100 cc. |
| Sodium hydroxide | 5 g. |
| Carboxymethyl hydroxyethyl cellulose | 3 g. |
| Titanium dioxide | 50 g. |

The control compound, 1,3-dithiane-1,1,3,3,-tetraoxide, and the compounds of Examples 1 to 4 and 6 were incorporated into the yellow image dye-providing layer of the photosensitive element on a molar equivalent basis. The amounts in terms of mgs/ft$^2$ were 50.0, 64.0, 53.0, 50.0 and 61.4 for Examples 1 to 4 and 6, respectively, and 31.4 mgs/ft$^2$ for the control. The control compound and those of Examples 3 and 4 were added to the gelatin as solid dispersions, and the compounds of Examples 1, 2 and 6 were added to the gelatin as solutions in a small amount of water-miscible organic solvent, such as, ethanol or acetone.

A layer approximately 0.0020 inch thick of the above-denoted processing composition was distributed between the photosensitive and image-receiving components by passing the superposed components between a pair of pressure-applying rolls. The "sandwich" was maintained intact and the reflection densities were measured as a function of time through the transparent support of the image-receiving component using a densitometer connected to a recorder. The dye transfer densities recorded at 15, 30, 60 and 100 seconds and at 5 minutes are set forth in Table I below.

TABLE I

| | Transfer Density | | | | | |
|---|---|---|---|---|---|---|
| Time | Control | Ex. 1 | Ex. 2 | Ex. 3 | Ex. 4 | Ex. 6 |
| 15 sec. | 0.64 | 0.32 | 0.18 | 0.30 | 0.36 | 0.34 |
| 30 sec. | 1.24 | 0.80 | 0.24 | 0.62 | 0.96 | 0.86 |
| 60 sec. | 1.68 | 1.56 | 0.36 | 1.20 | 1.72 | 1.60 |
| 100 sec. | 1.84 | 1.88 | 0.48 | 1.78 | 2.00 | 1.96 |
| 5 min. | 2.00 | 2.00 | 1.10 | *>2.13 | >2.00 | *2.02 |

*10 min.

As can be seen from the above data, the solvent precursors show an initial delay in solvent release as evidenced by the densities at 15 sec. compared to the control. By 100 sec. the densities of the precursors are comparable to the control except for Example 2. The final density of Example 2 is not as high, but this compound as indicated above has a substantially longer half-life.

Another series of film units was prepared in the same manner described above except that the gelatino-silver iodobromide layer contained 30 mgs/ft$^2$ of an oil dispersion of 4'-methylphenylhydroquinone, and the processing composition comprised the following ingredients.

| Processing Composition B | |
|---|---|
| Water | 100 cc. |
| Sodium hydroxide | 5 g. |
| Carboxymethyl hydroxyethyl cellulose | 3 g. |
| Thiouracil | 0.009 g. |
| Titanium dioxide | 50 g. |

These photosensitive elements were given an exposure through a stepwedge to white light of 2 mcs, superposed with said image-receiving elements, and a layer of said processing composition approximately 0.0020 inch thick was distributed between said elements by passing the film units between a pair of pressure-applying rolls in the dark. The film units were maintained intact to provide an integral negative-positive reflection print, and after about 10 minutes in the dark at room temperature, the maximum and minimum reflection densities were measured for the positive yellow image.

To determine the stability of the subject compounds to hydrolysis on standing in the film unit, additional photosensitive elements were stored for about 3 weeks or more at room temperature and then exposed and processed in the same manner described above. The reflection densities measured with the fresh film units before storage, and the reflection densities measured after storage of the photosensitive element are set forth in Table II below.

TABLE II

| Example No. | Transfer Densities ($D_{max}/D_{min}$) Fresh | After Ageing |
|---|---|---|
| Control | 1.89/1.19 | * |
| 1 | 1.60/0.52 | 1.48/0.60 |
| 2 | ** | ** |
| 3 | 1.53/0.46 | 1.50/0.46 |
| 4 | 1.74/0.36 | 1.83/0.34 |
| 6 | 1.60/0.41 | 1.63/0.38 |

*not measured

**No image was formed; this result is believed to be due to development of unexposed silver halide before availability of the silver halide solvent from this precursor which has a relatively long half-life.

As noted above, the subject silver halide solvent precursors undergo a retro-aldol reaction and are activated to release silver halide solvent by contact with aqueous alkali. Because they are stable, i.e., substantially inert until contacted with the aqueous alkaline processing composition, they may be placed in a variety of locations in the photographic film unit. They may be initially disposed in the photosensitive element, for example, in the silver halide emulsion layer, in a layer of dye image-forming material where appropriate or in a separate processing composition permeable layer, and/or they may be initially disposed in a second sheet-like element, for example, a spreader sheet, an image-receiving element adapted to be superposed with said photosensitive element or an image-receiving component forming part of an integral permanent laminate with said photosensitive element. The particular location selected generally is such that a given amount of silver solvent will be made available at a given position in the photographic system at a given time.

The developing agent, like the silver halide solvent precursor, may be initially included in a layer or layers of the film unit, for example, in the photosensitive element and may be disposed in the same layer as the silver halide solvent precursor. The developing agent also may be initially present in the processing composition, but it will be appreciated that positioning both the developing agent and silver halide solvent precursor in the film unit permits processing of the exposed film unit to be effected simply by applying aqueous alkali. The developing agent, like the silver halide solvent, may be provided as a developing agent precursor which precursor releases the developing agent when contacted with the processing composition. Such compounds are disclosed and claimed, for example, in aforementioned U.S. Pat. No. 3,698,898. Examples of other developing agents that may be employed are the p-aminophenols, the reductones and the various hydroquinones commonly used in the art.

It will be appreciated that the subject silver halide solvent precursors also may be used in admixture with each other and/or in admixture with other silver halide solvents or solvent precursors. When other solvents are used, they may be disposed in the processing composition.

Also, it will be appreciated that the subject compounds may be employed with alkali and viscosity-increasing reagents other than those specified above. For example, the alkali employed may be potassium or lithium hydroxide, and the viscosity-increasing reagent may be a cellulosic polymer, e.g., sodium carboxymethyl cellulose or hydroxyethyl cellulose; an oxime polymer, e.g., polydiacetone arylamide oxime; or other alkali-stable high molecular weight polymer. Such materials are well known in the art, and indeed, the subject compounds may be used in conjunction with antifoggants, development restrainers, toners, and other components as commonly used in photographic processes.

As mentioned previously, the subject compounds also may be employed in any of the various photographic film units known in the art either for use in conventional, i.e., "tray" photography or for use in diffusion transfer photography, either silver or color, diffusion transfer photography including integral negative-positive film units for preparing color transfer images viewable without separation as reflection prints as described, for example, in U.S. Pat. Nos. 3,415,644 and 3,594,165.

Since certain changes may be made in the hereindefined subject matter without departing from the scope of the invention herein involved, it is intended that all matter contained in the above description should be interpreted as illustrative and not in a limiting sense.

What is claimed is:

1. A photographic product which comprises a photosensitive silver halide emulsion layer carried on a support and a silver halide solvent precursor in a layer on the same side of said support as said silver halide emulsion layer, said silver halide solvent precursor being a compound selected from those represented by the formulae (I) 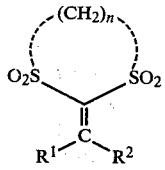 and (II) 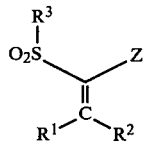

wherein $R^1$ and $R^2$, the same or different, each are hydrogen, alkyl, phenalkyl, phenyl, or phenyl substituted with an electron-donating or electron-withdrawing group; $R^3$ is alkyl, phenalkyl, phenyl, or substituted phenyl; Z is —CN or $—SO_2—R^4$ wherein $R^4$ is branched-chain alkyl, phenalkyl, phenyl, or substituted phenyl and n is an integer 3, 4 or 5.

2. A photographic product as defined in claim 1 which additionally includes a silver halide developing agent in a layer on the same side of said support as said silver halide emulsion layer.

3. A photographic product as defined in claim 1 which additionally includes an additive multicolor screen and a layer comprising silver precipitating nuclei disposed between said support and said silver halide emulsion layer.

4. A photographic product as defined in claim 3 wherein said silver halide solvent precursor is disposed in said silver halide emulsion layer.

5. A photographic product as defined in claim 1 wherein said $R^1$ and $R^2$ of formulae I and II are different.

6. A photographic product as defined in claim 5 wherein said silver halide solvent precursor is a compound of formula I.

7. A photographic product as defined in claim 6 wherein said n of formula I is 3.

8. A photographic product which comprises a first sheet-like element comprising a photosensitive silver halide emulsion layer carried on a support, a second sheet-like element adapted to be superposed with said first sheet-like element, means for retaining an aqueous alkaline processing composition for distribution between said first and second sheet-like elements, and a silver halide solvent precursor disposed in one or both of said sheet-like elements, said silver halide solvent precursor being a compound selected from those represented by the formulae

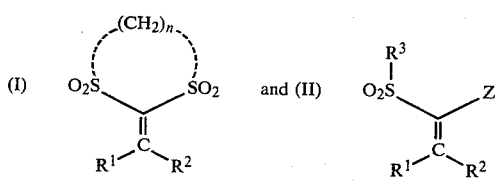

wherein $R^1$ and $R^2$, the same or different, each are hydrogen, akyl, phenalkyl, phenyl, or phenyl substituted with an electron-donating or electron-withdrawing group; $R^3$ is alkyl, phenalkyl, phenyl, or substituted phenyl; Z is —CN or $—SO_2—R^4$ wherein $R^4$ is branched-chain alkyl, phenalkyl, phenyl, or substituted phenyl and n is an integer 3, 4 or 5.

9. A photographic product as defined in claim 8 wherein said silver halide solvent precursor is disposed in said first sheet-like element.

10. A photographic product as defined in claim 8 wherein said $R^1$ and $R^2$ of formulae I and II are different.

11. A photographic product as defined in claim 10 wherein said $R^1$ is hydrogen.

12. A photographic product as defined in claim 11 wherein said silver halide solvent precursor is a compound of formula I.

13. A photographic product as defined in claim 9 wherein one of said first and second sheet-like elements additionally includes an image-receiving layer.

14. A photographic product as defined in claim 13 wherein said image-receiving layer is contained in said second sheet-like element.

15. A photographic product as defined in claim 14 wherein said image-receiving layer is a silver precipitating layer.

16. A photographic product as defined in claim 14 wherein said image-receiving layer is a dye image-receiving layer and said first sheet-like element additionally includes a dye image-forming material associated with said silver halide emulsion layer.

17. A photographic product as defined in claim 16 wherein said dye image-forming material associated with said silver halide emulsion layer is a photographically inert compound capable of undergoing cleavage in the presence of silver ions and/or soluble silver complex to liberate a diffusible dye.

18. A photographic product as defined in claim 17 wherein a silver halide developing agent is disposed in said first sheet-like element.

19. A photographic product as defined in claim 8 wherein said processing composition includes a viscosity-increasing reagent.

20. A photographic process which comprises (a) exposing imagewise a photosensitive element comprising a photosensitive silver halide emulsion layer carried on a support and a silver halide solvent precursor on the same side of said support as said emulsion layer, said silver halide solvent precursor being a compound selected from those represented by the formulae

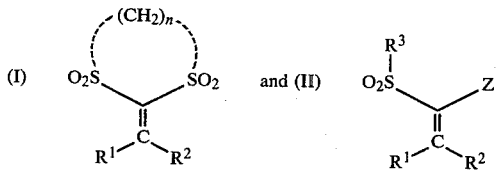

wherein $R^1$ and $R^2$, the same or different, each are hydrogen, alkyl, phenalkyl, phenyl, or phenyl substituted with an electron-donating or electron-withdrawing group; $R^3$ is alkyl, phenalkyl, phenyl, or substituted phenyl; Z is —CN or $—SO_2—R^4$ wherein $R^4$ is branched-chain alkyl, phenylalkyl, phenyl, or substituted phenyl and n is an integer 3, 4 or 5 and (b) applying to said exposed photosensitive element an aqueous alkaline processing composition to effect development of exposed silver halide and to effect release of silver halide solvent from said silver halide solvent precursor, thereby forming an imagewise distribution of silver complex soluble in said aqueous alkaline composition.

21. A photographic process as defined in claim 20 which includes the additional steps of (c) transferring said imagewise distribution of soluble silver complex to a superposed silver-precipitating layer and (d) reducing said transferred silver complex to provide a silver image.

22. A photographic process as defined in claim 20 wherein said photosensitive element includes a dye image-forming material associated with said silver halide emulsion layer and a dye image-receiving layer.

23. A photographic process as defined in claim 22 wherein said dye image-forming material is a photographically inert compound capable of undergoing cleavage in the presence of silver ions and/or soluble silver complex to liberate a diffusible dye and which includes the additional steps of contacting said image-wise distribution of soluble silver complex with said dye image-forming material to form a corresponding image-wise distribution of diffusible dye and transferring said diffusible dye to said dye image-receiving layer to form a dye image thereon.

* * * * *